US007458872B2

(12) United States Patent
Uda et al.

(10) Patent No.: US 7,458,872 B2
(45) Date of Patent: Dec. 2, 2008

(54) METHOD OF MANUFACTURING ELECTRON-EMITTING DEVICE, ELECTRON SOURCE, AND IMAGE DISPLAY DEVICE

(75) Inventors: Yoshimi Uda, Kanagawa-ken (JP); Yoshihiro Yanagisawa, Kanagawa-ken (JP); Kazuya Ishiwata, Kanagawa-ken (JP)

(73) Assignee: Canon Kabushiki Kaisha, Tokyo (JP)

( * ) Notice: Subject to any disclaimer, the term of this patent is extended or adjusted under 35 U.S.C. 154(b) by 759 days.

(21) Appl. No.: 11/016,774

(22) Filed: Dec. 21, 2004

(65) Prior Publication Data

US 2005/0148269 A1 Jul. 7, 2005

(30) Foreign Application Priority Data

Jan. 5, 2004 (JP) ..... 2004-000160

(51) Int. Cl.
*H01J 9/38* (2006.01)
*H01J 1/62* (2006.01)

(52) U.S. Cl. ..... 445/59; 313/495

(58) Field of Classification Search ..... 445/6, 445/59; 313/495–497
See application file for complete search history.

(56) References Cited

U.S. PATENT DOCUMENTS

| | | | | |
|---|---|---|---|---|
| 6,309,691 | B1 | 10/2001 | Hasegawa | 427/8 |
| 6,426,588 | B1 | 7/2002 | Yanagisawa | 313/422 |
| 6,490,433 | B1 * | 12/2002 | Kawade | 445/6 |
| 6,653,232 | B2 | 11/2003 | Uda et al. | 438/669 |
| 6,685,982 | B2 | 2/2004 | Hasegawa | 427/8 |
| 6,758,712 | B2 | 7/2004 | Kubo et al. | 445/24 |
| 6,786,787 | B2 | 9/2004 | Yanagisawa | 445/24 |
| 6,803,707 | B2 | 10/2004 | Ishiwata et al. | 313/310 |
| 6,815,884 | B2 | 11/2004 | Yamada et al. | 313/495 |
| 6,821,551 | B2 | 11/2004 | Hasegawa | 427/8 |
| 6,853,117 | B2 | 2/2005 | Toshima et al. | 313/304 |
| 2001/0024681 | A1 | 9/2001 | Hasegawa | 427/77 |
| 2002/0003398 | A1 | 1/2002 | Meguro et al. | 313/495 |
| 2002/0012748 | A1 | 1/2002 | Hasegawa | 427/256 |
| 2003/0049572 | A1 | 3/2003 | Watanabe et al. | 430/394 |
| 2003/0060114 | A1 | 3/2003 | Yanagisawa et al. | 445/24 |
| 2003/0141523 | A1 | 7/2003 | Watanabe et al. | 257/209 |

(Continued)

FOREIGN PATENT DOCUMENTS

| | | |
|---|---|---|
| EP | 0789383 | 8/1997 |

(Continued)

OTHER PUBLICATIONS

Notification of the First Office Action dated Jan. 25, 2008, regarding Application No. 200410011479.5.

(Continued)

*Primary Examiner*—Nimeshkumar D. Patel
*Assistant Examiner*—Anne M Hines
(74) *Attorney, Agent, or Firm*—Fitzpatrick, Cella, Harper & Scinto

(57) ABSTRACT

In a method of manufacturing an electron-emitting device, an electroconductive film formed on a substrate is subjected to a clean processing to remove a foreign matter from the electroconductive film, and thereafter, energization is conducted on the electroconductive film, to form an electron-emitting region. Accordingly, there is provided an electron-emitting device which avoids a formation defect of the electron-emitting region due to the existence of the foreign matter and which has satisfactory characteristics without fluctuation.

12 Claims, 7 Drawing Sheets

U.S. PATENT DOCUMENTS

2005/0019707 A1 1/2005 Watanabe et al. ..... 430/394

FOREIGN PATENT DOCUMENTS

| | | | |
|---|---|---|---|
| JP | 7-182973 | | 7/1995 |
| JP | 9274847 | | 10/1997 |
| JP | 2000-11860 | | 1/2000 |
| JP | 2000-149787 | | 5/2000 |
| JP | 2000246190 | A * | 9/2000 |
| JP | 2002216616 | | 8/2002 |
| JP | 2002313217 | | 10/2002 |
| JP | 2002358874 | | 12/2002 |
| JP | 2003068192 | | 3/2003 |

OTHER PUBLICATIONS

US 6,086,943, 07/2000, Hasegawa (withdrawn)

* cited by examiner

METHOD OF MANUFACTURING ELECTRON-EMITTING DEVICE, ELECTRON SOURCE, AND IMAGE DISPLAY DEVICE

BACKGROUND OF THE INVENTION

1. Field of the Invention

The present invention relates to a method of manufacturing an electron-emitting device. In addition, the present invention relates to a method of manufacturing an electron source including a plurality of the devices and a method of manufacturing an image display device constituted by using the electron source including the plural devices and an image-forming member.

2. Related Background Art

In recent years, an image display device having self-luminous electron-emitting devices arranged in matrix on a rear plate has been proposed. There are conventionally known two main types of electron-emitting devices: one using a thermal electron-emitting device, and the other using a cold-cathode electron-emitting device. Examples of the cold-cathode electron-emitting device include a field effect type electron-emitting device (hereinafter, referred to as "FE type"), a metal/insulating layer/metal type electron-emitting device (hereinafter, referred to as "MIM type"), and a surface conduction electron-emitting device.

Up to now, in the surface conduction electron-emitting device, an electron-emitting region has been generally formed by carrying out an energization operation called "forming" on an electroconductive thin film prior to electron emission. That is, the forming means that a DC voltage or an extremely slowly rising voltage is applied to both ends of the electroconductive thin film for energization to locally destruct, deform, or alter the electroconductive thin film, whereby the electron-emitting region brought into an electrically high resistance state is formed. In the surface conduction electron-emitting device which has been subjected to the energization forming operation, when a voltage is applied to the electroconductive thin film to allow a current to flow through the device, electrons are emitted from the electron-emitting region. Disclosed in Japanese Patent Application Laid-Open No. 2002-216616, for example, is an image display device using such surface conduction electron-emitting devices.

In addition, Japanese Patent Application Laid-Open No. H09-274847 (which corresponds to EP A1 789383) discloses a method of manufacturing an electron-emitting device, including checking on whether a foreign matter exists on a precursor film of an electroconductive thin film or not, and a method of manufacturing an electron-emitting device, including, when the foreign matter is adhered to the electroconductive thin film, removing from a substrate the electroconductive thin film to which the foreign matter is adhered and forming an electroconductive thin film on the substrate once again.

Meanwhile, in an image display device, electrons emitted from an electron-emitting device are accelerated to enter an image-forming member made of phosphor or the like, thereby obtaining luminance. Since the image display device responds in accordance with an input signal, it is necessary to electrically separate the electron-emitting devices from each other. For this reason, an insulating substrate is generally used in the image display device. However, when a surface of the insulating substrate is exposed in the vicinity of the electron-emitting region, a potential generated at the surface becomes unstable, which leads to instability in electron emission.

Upon application of a high voltage to the phosphor of the image-forming member, a potential is generated at the insulating surface in the vicinity of counter electron-emitting devices owing to capacitance division determined based on a dielectric constant of free space and a dielectric constant of an insulator. The more satisfactory insulating property the potential has, the longer its time constant becomes. Therefore, the electrostatically charged state of the surface is maintained. When electrons are emitted from the electron-emitting device in this state, the electrons collide against the electrostatically charged insulating surface as well. In this case, the electrons are accelerated, and when electrostatically charged particles such as electrons or ions are ejected into the insulating surface, secondary electrons are generated. In particular, abnormal electrostatic discharge is caused under the high electric field, and accordingly electron emission characteristics of the device decrease significantly. In the worst case, the electron-emitting device would be destroyed.

An influence caused by the electrostatic charge on the insulating surface becomes more prominent as a distance to an electron emission point is smaller. Thus, it is necessary to suppress the electrostatic charge especially in the vicinity of the electron-emitting device. As a means for coping with this, Japanese Patent Application Laid-Open No. 2002-358874 discloses a method in which an antistatic film is formed in the vicinity of the electron-emitting device by spraying a solution prepared by dispersing electroconductive fine particles in an organic solvent for coating.

SUMMARY OF THE INVENTION

The present invention has been made in light of the foregoing, and it is therefore an object of the present invention to provide a method of manufacturing an electron-emitting device which avoids a formation defect of an electron-emitting region due to the existence of a foreign matter and which has satisfactory electron emission characteristics.

Further, it is another object of the present invention to provide an electron source including a plurality of electron-emitting devices as well as an image display device constituted by using the electron source, which avoid fluctuation in electron emission characteristics due to the existence of a foreign matter and reduction in display image quality and which attain high reliability.

The present invention relates to a method of manufacturing an electron-emitting device, including: forming an electroconductive film on a substrate; removing a foreign matter from the electroconductive film formed; and, after removing the foreign matter, conducting energization on the electroconductive film from which the foreign matter is removed, to form an electron-emitting region on the electroconductive film.

Further, the present invention relates to a method of manufacturing an electron-emitting device, including: forming an electroconductive film on a substrate; ejecting a cleaning liquid to the electroconductive film formed, to clean the electroconductive film; and, after cleaning the electroconductive film, conducting energization on the electroconductive film cleaned, to form an electron-emitting region on the electroconductive film.

Further, the present invention relates to a method of manufacturing an electron source including a plurality of electron-emitting devices on a substrate, the method including using the method described above for manufacturing the electron-emitting devices.

Further, the present invention relates to a method of manufacturing an image display device which is constituted by using: an electron source including a plurality of electron-emitting devices on a substrate; and a light-emitting member arranged to face the electron source and adapted to emit light upon electron irradiation from the electron source, the method including using the method described above for manufacturing the electron-emitting devices.

DESCRIPTION OF THE PREFERRED EMBODIMENTS

Figure 1A:
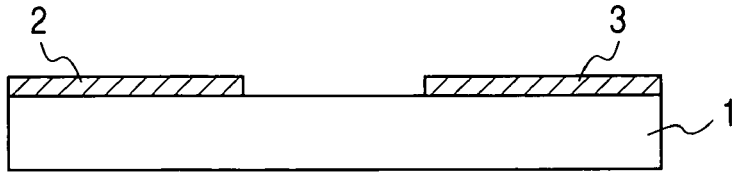
FIGS. 1A, 1B, 1C, and 1D are schematic diagrams illustrating steps in a method of manufacturing an electron-emitting device according to an embodiment mode of the present invention.

The present invention provides a method of manufacturing an electron-emitting device, including: forming an electroconductive film on a substrate; removing a foreign matter from the electroconductive film formed; and conducting energization on the electroconductive film from which the foreign matter is removed, to form an electron-emitting region on the electroconductive film.

Further, the present invention provides a method of manufacturing an electron-emitting device, including: forming an electroconductive film on a substrate; ejecting a cleaning liquid to the electroconductive film formed, to clean the electroconductive film; and conducting energization on the electroconductive film cleaned, to form an electron-emitting region on the electroconductive film.

The method of manufacturing the electron-emitting device according to the present invention described above includes the following configurations as preferred modes.

The foreign matter is removed from the electroconductive film by ejecting a cleaning liquid to the electroconductive film.

The cleaning liquid is ejected under a liquid pressure equal to or higher than 5 MPa.

Further, the cleaning liquid is ejected under a liquid pressure equal to or higher than 5 MPa and equal to or lower than 30 MPa.

Further, the foreign matter is removed from the electroconductive film after a resistive film has been formed on the substrate and on the electroconductive film.

The resistive film is formed by applying a liquid having an electroconductive particle dispersed therein onto the substrate and onto the electroconductive film.

The electroconductive particles contain $SnO_x$ as a main component.

In addition, the present invention provides a method of manufacturing an electron source including a plurality of electron-emitting devices on a substrate, the method including using the method described above for manufacturing the electron-emitting devices.

Moreover, the present invention provides a method of manufacturing an image display device which is constituted by using: an electron source including a plurality of electron-emitting devices on a substrate; and a light-emitting member arranged to face the electron source and adapted to emit light upon electron irradiation from the electron source, the method including using the method described above for manufacturing the electron-emitting devices.

The present invention described above has been made based on the following findings, which will be mentioned next.

When a foreign matter exists on an electroconductive film to be subjected to energization, the electroconductive film may not have a desired electrical resistance suitable for the above energization.

In another example, in a case where a plurality of the electroconductive films are simultaneously subjected to the energization, it takes too much time to form an electron-emitting region in the electroconductive film on which the foreign matter exists. Thus, there is such a fear that the formation of the electron-emitting region may not be completed in a predetermined period of time. In this case, there is a problem in that an electron-emitting device region where the electron-emitting region has not been formed results in a bit defect.

Then, in still another example, an influence due to existence of the foreign matter on the electroconductive film may cause fluctuation in electron emission characteristics of the thus formed electron-emitting devices. Further, the fluctuation in electron emission characteristics triggers a problem in that uniform performance cannot be maintained over the entire image display device.

The inventors of the present invention have learnt that especially when a resistive film is formed on the substrate surface on which the electron-emitting devices are formed, that is, when there is prepared a resistive film for preventing the substrate surface from being electrostatically charged, a foreign matter is adhered on the electroconductive film, whereby the above-mentioned problem is particularly likely to occur.

According to the present invention, the formation defect of the electron-emitting region in the electroconductive film due to the existence of the foreign matter is avoided, and it is possible to provide the method of manufacturing the electron-emitting device having satisfactory electron emission characteristics.

Furthermore, according to the present invention, it is possible to provide the method of manufacturing the highly reliable electron source including the plural electron-emitting devices as well as the image display device constituted by using the electron source, in which the fluctuation in electron emission characteristics due to the existence of the foreign matter and the reduction in display image quality are avoided.

EMBODIMENT MODE

Hereinafter, while referring to the attached drawings, a detailed description will be given to an embodiment mode of the present invention for an illustrative purpose. Note that the size, material, shape, relative position, etc., of components, which will be described in the embodiment mode, are not intended to limit the scope of the present invention to given examples unless specifically mentioned.

FIGS. 1A to 1D are schematic diagrams illustrating steps in a method of manufacturing an electron-emitting device according to the embodiment of the present invention. In the drawings, reference numeral 1 denotes a substrate, 2 and 3 denote electrodes, 5 denotes resistive films (antistatic films), 6 denotes an electron-emitting region, and 4 denotes an electroconductive film formed before the electron-emitting region 6 is formed.

Figure 1B:
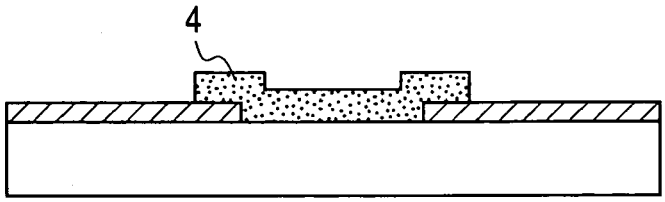
Figure 1C:
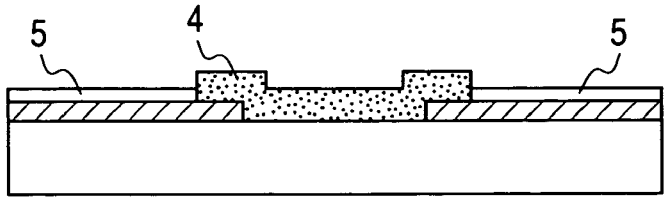
Figure 1D:
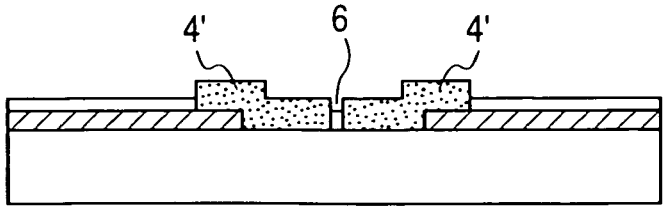
Figure 2A:
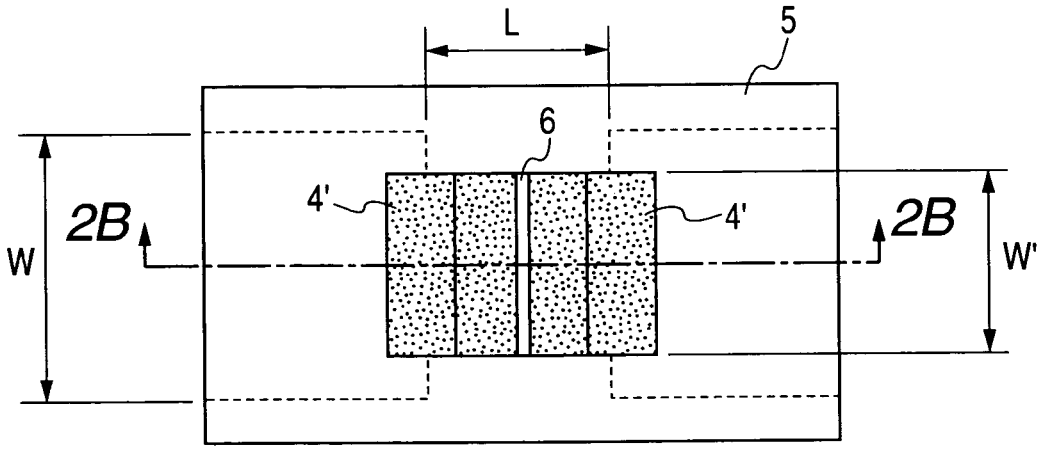
FIGS. 2A and 2B are schematic diagrams illustrating a structure of the electron-emitting device obtained through the manufacturing method shown in FIGS. 1A, 1B, 1C, and 1D.
Figure 2B:
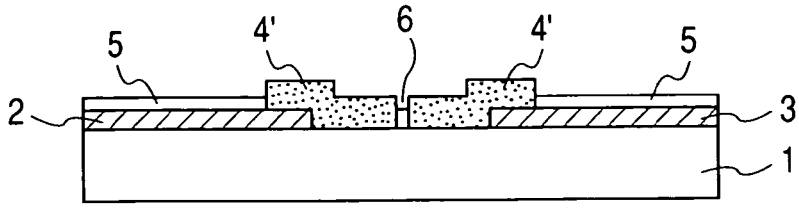

Then, FIGS. 2A and 2B are schematic diagrams illustrating a structure of the electron-emitting device manufactured through steps of FIGS. 1A to 1D. FIG. 2A is a plane view, and FIG. 2B is a cross sectional view taken along the line 2B-2B of FIG. 2A. In the drawings, reference numeral 4' denotes device films formed after the electron-emitting region 6 has been formed, and the same structural components as those in FIGS. 1A to 1D are denoted by the same reference numerals. Each manufacturing step and the device structure will be described below in detail.

(Step 1)

The insulating substrate 1 is sufficiently cleaned using a cleaning material, purified water, an organic solvent, etc. An electrode material is deposited on the substrate through a vacuum evaporation method, a sputtering method, or the like. Patterning is conducted on the deposited electrode material by means of photolithography or the like, thereby forming the electrodes 2 and 3 (FIG. 1A).

For example, a quartz glass substrate, a substrate made of glass having a reduced content of impurity such as Na, a soda lime glass substrate, a glass substrate obtained by forming $SiO_2$ on soda lime glass through a sputtering method or the like for stack, a substrate made of ceramic such as alumina, or an Si substrate can be used as the substrate 1.

A general electroconductive material can be used for the counter electrodes 2 and 3. It is possible to arbitrarily select one material of: a metal such as Ni, Cr, Au, Mo, W, Pt, Ti, Al, Cu, or Pd or an alloy thereof; a printing conductor composed of a metal or metal oxide such as Pd, Ag, Au, $RuO_2$, or Pd—Ag, and glass or the like; a transparent electroconductive material such as $In_2O_3$—$SnO_2$; and a semiconductor material such as polysilicon.

A gap interval L between the electrodes 2 and 3, a length W of the electrodes 2 and 3, and the like are appropriately designed in consideration with a mode to be applied, etc. The gap interval L between the electrodes 2 and 3 can be set preferably in a range from several hundreds of nm to several hundreds of μm, and more preferably in a range from several μm to several tens of μm.

Also, the length W of the electrodes 2 and 3 can be set preferably in a range from several μm to several hundreds of μm, and a thickness thereof can be set preferably in a range from several tens of nm to several μm.

(Step 2)

The electroconductive film 4 is formed for electrically connecting the electrodes 2 and 3 to each other (FIG. 1B).

A thickness of the electroconductive film 4 is appropriately set while a consideration is given to a step coverage of the electrodes 2 and 3, a resistance between the electrodes 2 and 3, conditions for a forming operation which will be described below, and so forth. In usual cases, for the thickness of the electroconductive film 4, a range from several hundreds of pm to several hundreds of nm is preferable, and a range from 1 nm to 50 nm is more preferable. In addition, a sheet resistance value of the electroconductive film 4 is preferably set to $10^7$ Ω/□ or lower. The sheet resistance value of the electroconductive film 4 is limited to a resistance value with which a satisfactory electron-emitting region can be formed in the step of forming the electron-emitting region 6, that is, in the forming operation. Note that when a width of the electroconductive film 4 is assigned W', the gap interval of the counter electrodes 2 and 3 is assigned L, and a resistance value of the electroconductive film 4 is assigned R, the sheet resistance value is represented by Rs which satisfies an equation of R=Rs (L/W'). To satisfactorily form the electron-emitting region 6, a sheet resistance value of the electroconductive film 4 is preferably in a range from $10^3$ Ω/□ to $10^7$ Ω/□.

However, after the electron-emitting region 6 has been formed, it is preferred that a voltage applied through the electrodes 2 and 3 be sufficiently applied to the electron-emitting region 6, and thus a resistance value of the device film 4' which contains the electron-emitting region 6 be lower. For this reason, the electroconductive film 4 is composed of a metal oxide semiconductor film having a sheet resistance value of $10^3$ Ω/□ or larger and $10^7$ Ω/□ or lower. Then, the electroconductive film 4 is reduced after the forming operation, whereby it is possible to use the resultant film as a metal thin film having a lower resistance value. Accordingly, a lower limit for the resistance value of the device film 4' containing the electron-emitting region 6 in the final state is not particularly limited. Note that, the resistance value of the device film 4' containing the electron-emitting region 6 refers herein to a resistance value measured at a region which does not contain the electron-emitting region 6.

A material of an electroconductive film 4 is suitably selected from: a metal such as Pd, Pt, Ru, Ag, Au, Ti, In, Cu, Cr, Fe, Zn, Sn, Ta, W, or Pb; an oxide such as PdO, $SnO_2$, $In_2O_3$, PbO, or $Sb_2O_3$; a boride such as $HfB_2$, $ZrB_2$, $LaB_6$, $CeB_6$, $YB_4$, or $GdB_4$; a carbide such as TiC, ZrC, HfC, TaC, SiC, or WC; a nitride such as TiN, ZrN, or HfN; a semiconductor such as Si or Ge; and carbon.

An ink jet system apparatus can be used for the method of forming the electroconductive film 4. To be specific, an ink jet ejecting apparatus using a piezoelectric device etc., a so-called Bubble Jet (registered trademark) system ink jet ejecting apparatus utilizing thermal energy, or the like is used. A solution prepared by dissolving a constituting material of the electroconductive film 4 into water or a solvent, or a solution such as an organic metal solution is applied on the substrate 1 in the form of ink droplets. A desired processing such as heating is conducted on the resultant, thereby obtaining the electroconductive film 4.

(Step 3)

Resistive films (antistatic films) 5 are formed in the vicinity of the electroconductive film 4 (FIG. 1C) as the need arises for preventing the surface of the substrate 1 from being electrostatically charged.

A sheet resistance value of the antistatic film 5 is preferably set to about $10^{10}$ Ω/□ to $10^{12}$ Ω/□ in view of preventing electrostatic discharge caused by electrostatic charge. In addition, when the antistatic film 5 is used to fabricate the electron source, a sheet resistance value thereof is required to be $10^8$ Ω/□ or higher in consideration with a permissible value of a leak current between XY wirings.

The antistatic film 5 is obtained by spraying an organic solvent having electroconductive fine particles dispersed therein and drying and removing the organic solvent. Fine particles containing a carbon material, $SnO_x$, chrome oxide, or the like, as a main component are preferably used as the electroconductive fine particles, and $SnO_x$ doped with antimony or the like is more preferably used. It is preferred to use alcohols as an organic solvent, for example, a liquid mixture of isopropyl alcohol (IPA) and ethyl alcohol is preferably used.

Next, before an energization operation is conducted, which will be described below, a foreign matter removal step on the electroconductive film 4 is carried out. More specifically, a surface of the electroconductive film 4 is cleaned using an appropriate cleaning liquid. Purified water or a generally-used cleaning liquid is preferably adopted as the cleaning liquid employed in the present invention. Further, in cleaning the substrate surface, the cleaning liquid is preferably ejected at a predetermined liquid pressure, in particular, at a liquid pressure of 5 MPa or higher, thereby making it possible to remove the foreign matter efficiently. An upper limit of the liquid pressure will be set to a maximum value as long as other structural components are not damaged by the ejection, and in usual cases, the upper limit is set to about 30 MPa based on a performance of an industrial cleaning apparatus. Moreover, according to the present invention, an ultrasonic clean processing or the like is preferably adopted. After the cleaning, in a case where a cleaning liquid other than purified water is used, the cleaning liquid is removed with purified water and then drying is conducted when necessary.

(Step 4)

The energization operation is conducted on the electroconductive film 4 to form the electron-emitting region 6 (FIG. 1D). The electron-emitting region 6 is composed of a high resistance fissure formed in a part of the device film 4', and is formed depending on the thickness, quality, material, conditions for energization operation, etc., of the electroconductive film 4.

Electroconductive fine particles having a size in a range from several hundreds of pm to several tens of nm may be present in the fissure of the electron-emitting region 6. The electroconductive fine particles each contain a part or all of the elements of the materials constituting the electroconductive film 4. Further, the electron-emitting region 6 including the fissure, and the device film 4' existing in the vicinity of the electron-emitting region 6 may contain carbon and a carbon compound.

A voltage waveform applied to the electroconductive film 4 has preferably a pulsed waveform, for which there is employed a method of continuously applying pulses using a pulse height value as a constant voltage or a method of applying voltage pulses while a pulse height value is increased. In the former method, a pulse width of the voltage waveform is set in a range from 1 μs to 10 ms, and a pulse interval is set in a range from 10 μs to 10 ms. The pulse waveform may be appropriately selected from a chopping wave, a rectangular wave, and the like in accordance with a mode of the electron-emitting device. Under the above conditions, a voltage is applied for several seconds to several tens of minutes, for example. In the latter method, a pulse width and a pulse interval are set in the same manner as described above, a crest value (peak voltage during energization) can be increased stepwise by about 0.1 V, for example.

At the time of completing the energization operation, a current flowing through the electroconductive film 4 is measured while a voltage having a pulse interval at a level where a local destruction or change in shape does not occur in the film 4 is applied to it, and thereby its resistance value can be detected. For example, a device current flowing when voltage application of about 0.1 V is conducted is measured to find out a resistance value. When the resistance value shows 1 MΩ, the energization operation is ended.

It should be noted that in this embodiment mode, the antistatic films 5 are formed, which however do not affect basic characteristics of the electron-emitting device. This is because the antistatic film 5 has a sufficiently high resistance value ($10^8$ Ω/□ or higher), and therefore the leak current flowing through the device film 4' is sufficiently smaller than the device current measured when electron emission is conducted.

Also in this embodiment mode, after the electroconductive film 4 has been formed, the antistatic films 5 are formed in the vicinity of the electroconductive film 4. However, the present invention is not limited to the above-mentioned mode. A mode disclosed in Japanese Patent Application Laid-Open No. 2002-313217 where the antistatic film is formed over the entirety of the substrate before formation of the electroconductive film 4, or a mode disclosed in Japanese Patent Application Laid-Open No. 2003-68192 where the antistatic film is formed on the entirety of the substrate including an area above the electroconductive film 4 is also applicable.

According to the description in this embodiment mode, the electroconductive film 4 is formed after the electrodes 2 and 3 have been formed. However, according to the present invention, such a structure may be applicable where the electrodes 2 and 3 are formed after the formation of the electroconductive film 4. In addition, when the provision of the antistatic film 5 is unnecessary, the manufacturing step therefor is skipped, and after the electroconductive film 4 has been formed, the foreign matter removal step may be conducted.

Figure 3:
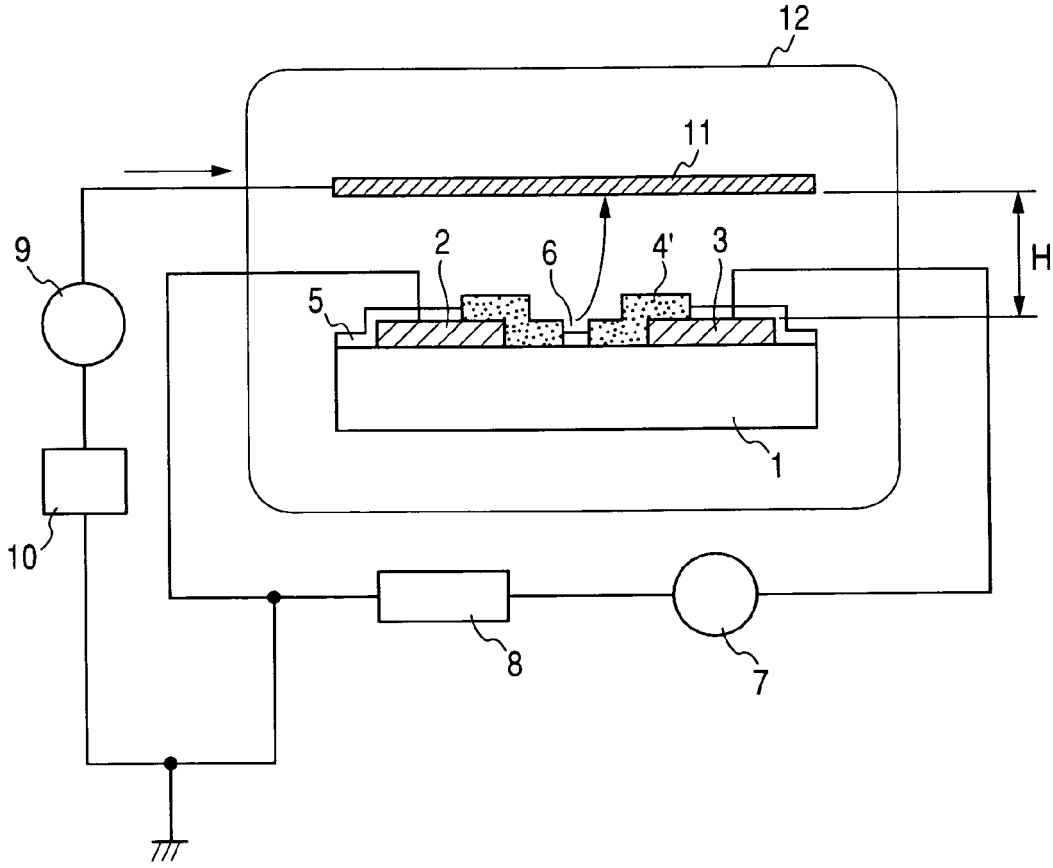
FIG. 3 is a schematic diagram illustrating an evaluation apparatus for electron emission characteristics of the electron-emitting device according to the present invention.

The electron-emitting device manufactured in the above-mentioned manner is mounted to a measurement evaluation apparatus shown in FIG. 3 for evaluation of electron emission characteristics.

In the apparatus shown in FIG. 3, reference numeral 12 denotes a vacuum apparatus, which includes an exhaust pump (not shown). Further, reference numeral 8 denotes a power supply for applying the electron-emitting device with a device voltage Vf, 7 denotes an ammeter for measuring a device current If flowing through the device film 4' between the electrodes 2 and 3, 11 denotes an anode electrode for capturing an emission current Ie emitted from the electron-emitting region 6 of the device. Moreover, reference numeral 10 denotes a high voltage power supply for applying the anode electrode 11 with a voltage, and 9 denotes an ammeter for measuring the emission current Ie emitted from the electron-emitting region 6 of the device.

For example, a voltage of the anode electrode 11 is set in a range from 1 kV to 10 kV, and a distance H between the anode electrode 11 and the electron-emitting device is set in a range from 2 mm to 8 mm for measurement. Provided in a vacuum chamber 12 are a vacuum gauge (not shown) and other devices necessary for the measurement under a vacuum atmosphere, which are adapted to perform measurement evaluation under a desired vacuum atmosphere.

Figure 4:
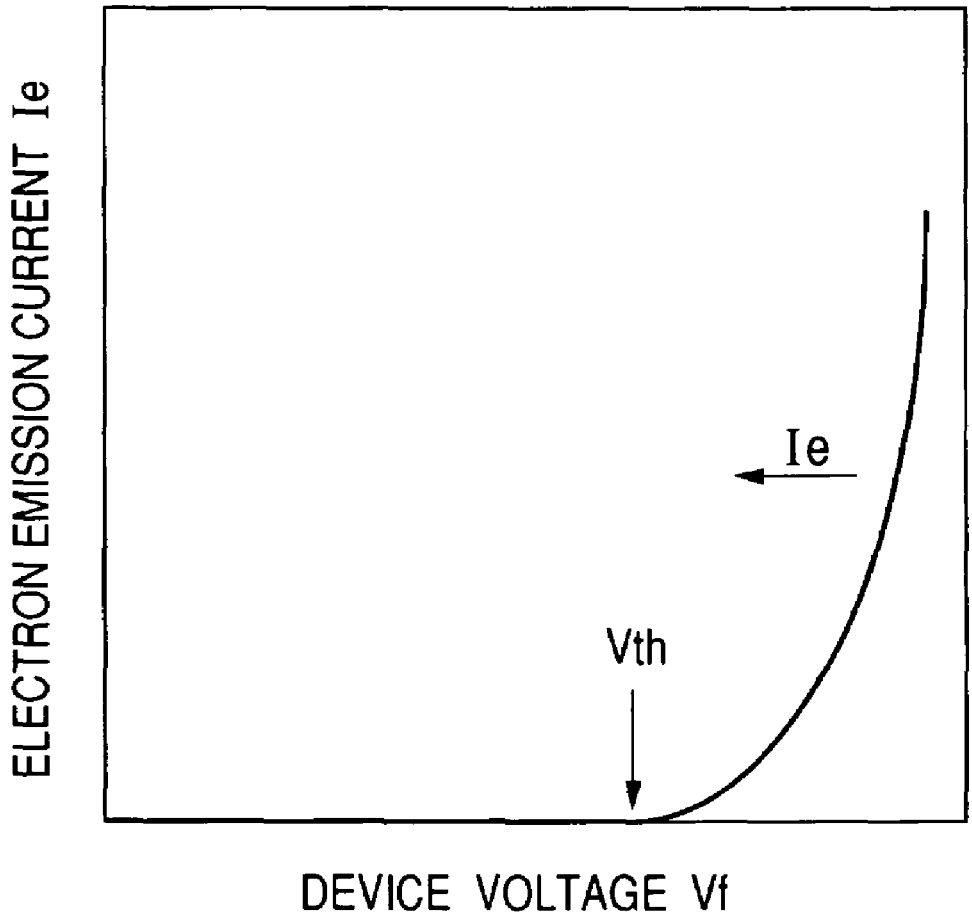
FIG. 4 is a schematic diagram illustrating electron emission characteristics of the electron-emitting device according to the present invention.
Figure 5:
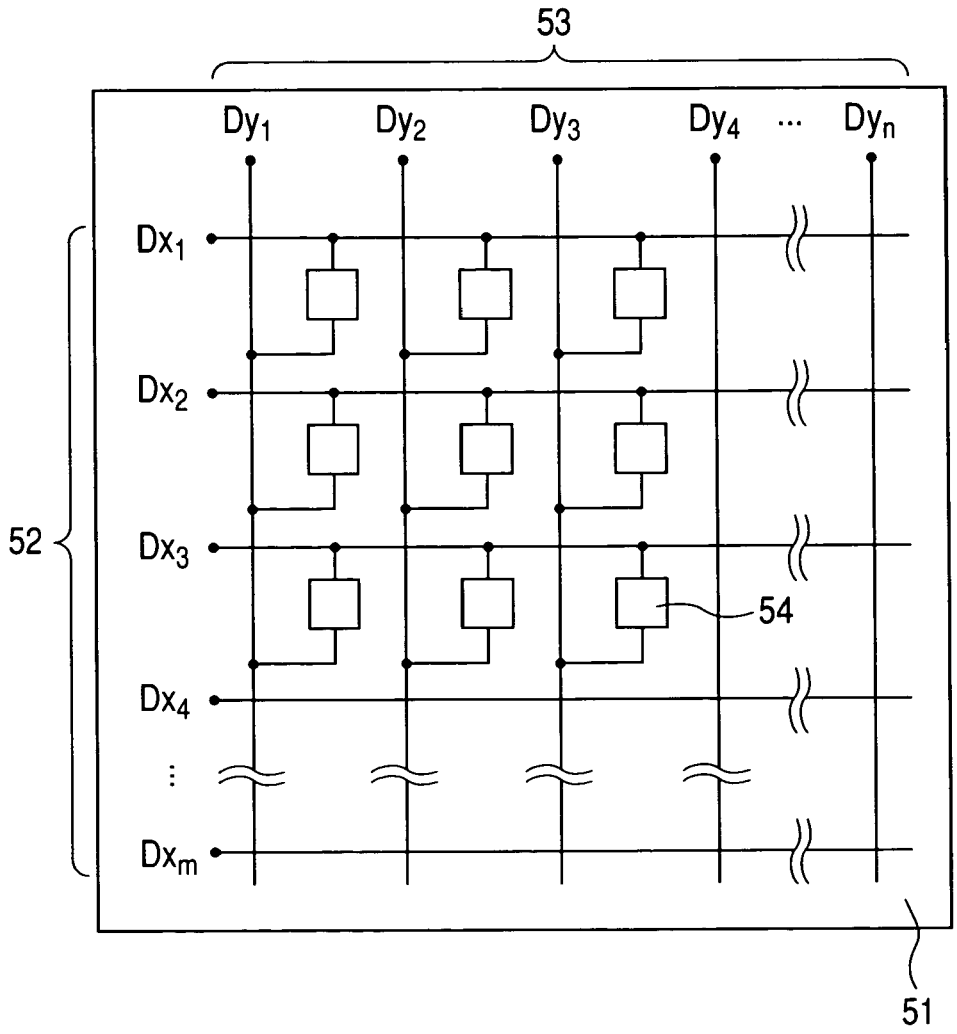
FIG. 5 is a schematic diagram illustrating an electron source including the electron-emitting devices shown in FIGS. 2A and 2B.

FIG. 4 is a schematic diagram illustrating a relation between the emission current Ie and the device voltage Vf based on results from measurement of the electron emission characteristics of the electron-emitting device according to the present invention by using the measurement evaluation apparatus shown in FIG. 5.

Next, a description will be given to a method of manufacturing the electron source according to the present invention. FIG. 5 is a schematic diagram of a structural example of the electron source including the plural electron-emitting devices shown in FIGS. 2A and 2B. In FIG. 5, reference numeral 51 denotes an electron source substrate, 52 denotes X directional wirings, 53 denotes Y directional wirings, and 54 denotes electron-emitting devices according to the present invention. Note that in FIG. 5, the antistatic films 5 shown in FIGS. 2A and 2B are omitted for the sake of simplicity.

The X directional wirings 52 include m wirings Dx1, Dx2, . . . Dxm, and are each formed of an electroconductive metal etc., formed through a vacuum evaporation method, a printing method, a sputtering method, or the like. The material, thickness, and width of the wirings may be appropriately designed. The Y directional wirings 53 include n wirings Dy1, Dy2, . . . Dyn, and are each made similarly to the X directional wirings 52. Interlayer insulating layers (not shown) are provided between those m X directional wirings 52 and the n Y directional wirings 53 to electrically separate the wirings from each other. Herein, m and n are each a positive integer. The interlayer insulating layer (not shown) is made of $SiO_2$ etc., formed through a vacuum evaporation method, a printing method, a sputtering method, or the like. The X directional wirings 52 and the Y directional wirings 53 can be extracted as external terminals, respectively (Dox1 to Doxm and Doy1 to Doyn shown in FIG. 6 as will be described below).

Electrically connected to one of the m X directional wirings 52 and one of the n Y directional wirings 53 are the electrodes 2 and 3, respectively, which constitute the electron-emitting device 54.

The X directional wirings 52, the Y directional wirings 53, and the electrodes 2 and 3 are made of materials whose constituting elements may be all the same, partially the same, or different from each other. When the material of the electrodes 2 and 3 is the same as that of the wiring, the X directional wirings 52 and the Y directional wirings 53 can be also regarded as the electrode 2 and the electrode 3, respectively.

Scanning signal application means (not shown) for applying a scanning signal for selecting one of rows arranged in the X direction of the electron-emitting device 54 is connected to the X directional wirings 52. On the other hand, modulation signal generation means (not shown) for modulating the columns arranged in the Y direction of the electron-emitting device 54 in accordance with the input signal is connected to the Y directional wirings 53. A drive voltage to be applied to the respective electron-emitting devices is supplied in the form of a difference voltage between the scanning signal and the modulation signal applied to the electron-emitting device.

The manufacturing method for the electron source according to the present invention is similar to that for the electron-emitting device described above except that the plural devices are formed on the same substrate 1.

Figure 6:
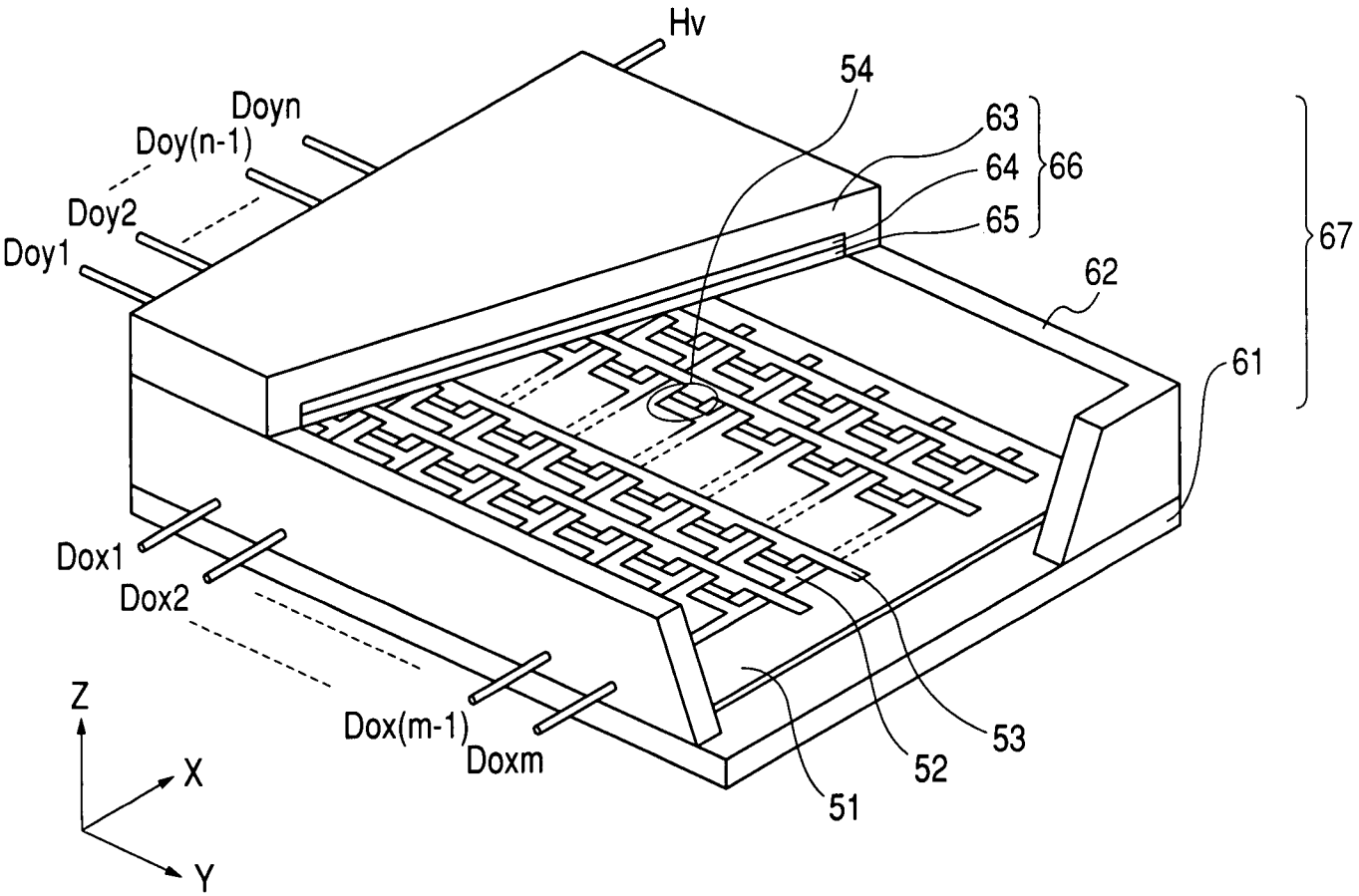
FIG. 6 is a schematic diagram illustrating a structure of a display panel of an image display device constituted by using the electron source shown in FIG. 5.

According to the structure shown in FIG. 5, the electron-emitting devices are individually selected, thus allowing the devices to be individually driven. While referring to FIG. 6, the image display device constituted by using the electron source having the above-mentioned matrix arrangement will be described. FIG. 6 is a schematic diagram of an example of a display panel for the image display device.

In FIG. 6, reference numeral 51 denotes an electron source substrate having the plural electron-emitting devices 54 arranged thereon, 61 denotes a rear plate fixing the electron source substrate 51 thereto, and 66 denotes a face plate (image-forming member) in which a fluorescent material film 64 made of a luminant such as phosphor provided on an inner surface of a glass substrate 63 and a metal back 65 serving as the anode electrode are formed. Reference numeral 62 denotes a supporting frame. Connected to the supporting frame 62 are the rear plate 61 and the face plate 66 by using frit glass or the like. Reference numeral 67 denotes an enclosure, which is structured through bonding by baking in a temperature range from 400 to 500° C. in an air or nitrogen atmosphere for 10 minutes or longer, for example.

As described above, the enclosure 67 is structured by the face plate 66, the supporting frame 62, and the rear plate 61. The rear plate 61 is provided for a purpose of enhancing the strength of the substrate 51 mainly, so when the substrate 51 itself has a sufficient strength, it is unnecessary to separately provide the rear plate 61. In other words, the enclosure 67 may be structured by bonding the supporting frame 62 directly to the substrate 51 and only using the face plate 66, the supporting frame 62, and the substrate 51. At the same time, a supporting member called spacer (not shown) may be arranged between the face plate 66 and the rear plate 61, whereby the enclosure 67 can also be structured to have a sufficient strength to the atmospheric pressure.

The image display device according to the present invention may be employed as an image display device for a photo printer constituted by using a photosensitive drum and the like, in addition to a television broadcasting display device, display devices for a television conference, a computer, and so forth.

EMBODIMENTS

Embodiment 1

PD200 (glass substrate) was used for the substrate, while also being used in a plasma display device. Then, Pt was deposited on the substrate through a sputtering film formation method or a photolithography etching method to have a thickness of about 0.5 μm, and a plurality of electrode pairs were formed. Subsequently, there were conducted steps of film formation by means of screen printing using an Ag based photo paste, drying at a temperature of about 100° C., exposure using a pattern mask, and wet development, before baking at a temperature lower than 500° C., thereby fabricating column wirings having a thickness of about 8 μm. Further, while a PbO (lead glass) based photo paste was used, steps of film formation/drying/exposure/development/baking were performed three times in the same manner as in the steps for formation of column wirings, whereby an insulating layer having a final thickness of about 30 μm was formed. Further, Ag based screen printing and baking at a temperature of about 430° C. were conducted to fabricate row wirings on the insulating layer. Following that, an island-shaped pattern having a thickness of 0.01 μm was formed by ejecting a Pd based organic solvent through an ink jet method for electrically connecting the respective electrode pairs to each other, and electroconductive films made of Pd were then formed.

Cleaning was conducted on the above substrate using purified water as a cleaning liquid while its ejecting pressure was varied. A high foreign matter removal effect was attained in a case where cleaning was conducted at the ejecting pressure of 5 MPa or higher, as seen from comparison results with a method capable of counting a foreign matter having a size of about 10 μm or larger by a pattern detecting device.

Embodiment 2

Similarly to Embodiment 1, after a plurality of electrode pairs, wirings, and electroconductive films had been formed on the glass substrate, antistatic films were formed over the entirety of the substrate while the electroconductive films were left uncovered. The antistatic films were formed by spraying a solution prepared by dispersing fine particles of $SnO_2$ doped with antimony into a liquid mixture of IPA and ethyl alcohol for coating before drying and baking at 250° C.

Figure 7:
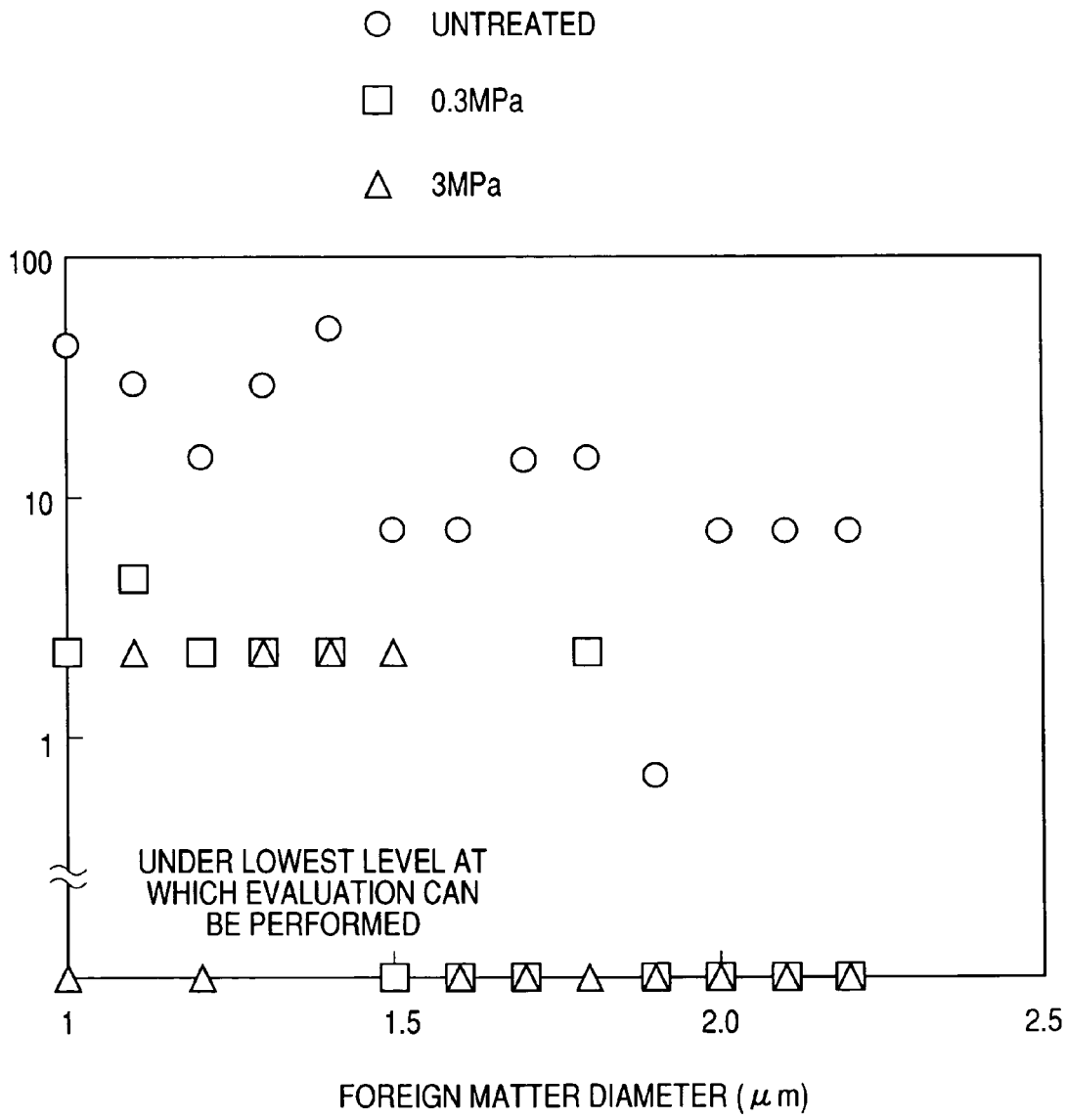
FIG. 7 is a diagram representing results according to an embodiment of the present invention.

Subsequently, as in Embodiment 1, a clean processing was carried out while its liquid pressure was varied to test out a foreign matter removal effect. The removal effects have been evaluated by comparing count values of the foreign matters of sizes substantially equal to or larger than 1 μm through an electron microscope. FIG. 7 shows results. A vertical axis in FIG. 7 indicates the number of the foreign matters per unit area. When the clean processing was carried out, a superior effect was attained as compared to a case where electroconductive films were untreated with the clean processing. In addition, as the liquid pressure of the cleaning liquid is higher, a finer foreign matter may be effectively removed. It should be noted that in addition to the cases shown in FIG. 7, in a case where the liquid pressure was set to 10 MPa and a case where the substrate was immersed in purified water and subjected to ultrasonic cleaning for 5 minutes, no foreign matter sized equal to or larger than the evaluable limit size (i.e., substantially no foreign matter) was detected.

This application claims priority from Japanese Patent Application No. 2004-000160 filed on Jan. 5, 2004, which is hereby incorporated by reference herein.

What is claimed is:

1. A method of manufacturing an electron-emitting device, comprising steps of:

forming an electroconductive film on a substrate;

removing a foreign matter from the electroconductive film formed; and after removing the foreign matter, conducting energization on the electroconductive film, to form an electron-emitting region on the electroconductive film, wherein the foreign matter is removed from the electroconductive film by ejecting a cleaning liquid to the electroconductive film, and the cleaning liquid is ejected under a liquid pressure equal to or higher than 5 MPa.

2. A method of manufacturing an electron-emitting device according to claim 1, wherein the cleaning liquid is ejected under a liquid pressure equal to or lower than 30 MPa.

3. A method of manufacturing an electron-emitting device according to claim 1, wherein the foreign matter is removed from the electroconductive film after a resistive film has been formed on the substrate and on the electroconductive film.

4. A method of manufacturing an electron-emitting device according to claim 3, wherein the resistive film is formed by applying a liquid having an electroconductive particle dispersed therein onto the substrate and onto the electroconductive film.

5. A method of manufacturing an electron source comprising a plurality of electron-emitting devices on a substrate, the method comprising using the method according to claim 1 for manufacturing the electron-emitting devices.

6. A method of manufacturing an image display device which is constituted by using: an electron source comprising a plurality of electron-emitting devices on a substrate; and a light-emitting member arranged to face the electron source and adapted to emit light upon electron irradiation from the electron source, the method comprising using the method according to claim 1 for manufacturing the electron-emitting devices.

7. A method of manufacturing an electron-emitting device, comprising steps of:

forming an electroconductive film on a substrate;

ejecting a cleaning liquid to the electroconductive film formed, to clean the electroconductive film; and after cleaning the electroconductive film, conducting energization on the electroconductive film cleaned, to form an electron-emitting region on the electroconductive film, wherein the cleaning liquid is ejected under a liquid pressure equal to or higher than 5 MPa.

8. A method of manufacturing an electron-emitting device according to claim 7, wherein the cleaning liquid is ejected under a liquid pressure equal to or lower than 30 MPa.

9. A method of manufacturing an electron-emitting device according to claim 7, wherein the electroconductive film is cleaned after a resistive film has been formed on the substrate and on the electroconductive film.

10. A method of manufacturing an electron-emitting device according to claim 9, wherein the resistive film is formed by applying a liquid having an electroconductive particle dispersed therein onto the substrate and onto the electroconductive film.

11. A method of manufacturing an electron source comprising a plurality of electron-emitting devices on a substrate, the method comprising using the method according to claim 7 for manufacturing the electron-emitting devices.

12. A method of manufacturing an image display device which is constituted by using: an electron source comprising a plurality of electron-emitting devices on a substrate; and a light-emitting member arranged to face the electron source and adapted to emit light upon electron irradiation from the electron source, the method comprising using the method according to claim 7 for manufacturing the electron-emitting devices.

* * * * *